US007766798B2

(12) United States Patent
Hamilton

(10) Patent No.: US 7,766,798 B2
(45) Date of Patent: Aug. 3, 2010

(54) BICYCLE TRAINER WITH VARIABLE RESISTANCE TO PEDALING

(76) Inventor: Brian H. Hamilton, 7211 Seton House La., Charlotte, NC (US) 28277

( * ) Notice: Subject to any disclaimer, the term of this patent is extended or adjusted under 35 U.S.C. 154(b) by 91 days.

(21) Appl. No.: 12/206,696

(22) Filed: Sep. 8, 2008

(65) Prior Publication Data

US 2010/0062908 A1 Mar. 11, 2010

(51) Int. Cl.
*A63B 69/16* (2006.01)

(52) U.S. Cl. ..... 482/61; 434/61

(58) Field of Classification Search ..... 482/5, 482/51, 57, 61; 601/36; 434/61; 211/1, 211/17, 20, 22, 23, 24, 175, 207
See application file for complete search history.

(56) References Cited

U.S. PATENT DOCUMENTS

| | | | | |
|---|---|---|---|---|
| 627,483 | A | 6/1899 | Comly | |
| 1,661,679 | A | 3/1928 | Privett | |
| 2,462,018 | A | 2/1949 | Wood | |
| 2,972,478 | A * | 2/1961 | Raines | 482/61 |
| 4,506,676 | A | 3/1985 | Duska | |
| 4,752,066 | A | 6/1988 | Housayama | |
| 4,813,062 | A | 3/1989 | Gilpatrick | |
| 4,955,600 | A * | 9/1990 | Hoffenberg et al. | 482/61 |
| 4,958,832 | A | 9/1990 | Kim | |
| 5,031,901 | A | 7/1991 | Saarinen | |
| 5,193,106 | A | 3/1993 | DeSena | |
| 5,236,069 | A | 8/1993 | Peng | |
| 5,382,208 | A * | 1/1995 | Hu | 482/63 |
| 5,545,982 | A | 8/1996 | Vlakancic | |
| 5,656,001 | A | 8/1997 | Baatz | |
| 5,916,067 | A | 6/1999 | Morasse | |
| 6,042,517 | A | 3/2000 | Gunther et al. | |
| 6,116,415 | A | 9/2000 | Rastelli | |
| 6,508,745 | B1 | 1/2003 | Schenk et al. | |
| 6,568,446 | B1 | 5/2003 | Schulte | |
| 6,712,737 | B1 * | 3/2004 | Nusbaum | 482/8 |
| 6,857,992 | B1 | 2/2005 | Kolda et al. | |
| 6,945,916 | B2 | 9/2005 | Schroeder | |
| 6,945,917 | B1 | 9/2005 | Baatz | |
| 6,964,633 | B2 | 11/2005 | Kolder et al. | |
| 7,011,607 | B2 | 3/2006 | Kolda et al. | |
| 7,083,551 | B1 | 8/2006 | Lassanske et al. | |
| 7,226,395 | B2 * | 6/2007 | Wu et al. | 482/57 |
| 7,303,510 | B2 * | 12/2007 | Gebhardt | 482/61 |

(Continued)

*Primary Examiner*—Loan H Thanh
*Assistant Examiner*—Tam Nguyen
(74) *Attorney, Agent, or Firm*—Summa, Addition & Ashe, P.A.

(57) ABSTRACT

The invention is a bicycle trainer to which a standard bicycle temporarily attaches for exercise and simulated rides. A lifting mechanism raises and lowers the front tire, and in preferred embodiments, a frame engages the rear tire to hold the rear tire in an elevated position against a resistance cylinder. The resistance cylinder provides a force against rear tire revolution and varies the resistance to pedaling. The resistance cylinder can vary resistance against back tire revolution by pumping a resistance fluid into and out of the cylinder, by changing the position of the resistance cylinder in relation to the back tire, or by translation of the bicycle back and forth. In other embodiments, the trainer is electronically controlled to simulate real-world geographical courses programmed into a readable format for electronically maneuvering front tire and back tire positions as necessary to provide resistance to pedaling.

8 Claims, 17 Drawing Sheets

U.S. PATENT DOCUMENTS

| | | | |
|---|---|---|---|
| 7,314,434 | B2 | 1/2008 | Chen |
| D593,625 | S | 6/2009 | Pedrini |
| 2002/0055422 | A1 | 5/2002 | Airmet et al. |
| 2002/0193207 | A1 | 12/2002 | Wang |
| 2003/0073546 | A1 | 4/2003 | Lassanske et al. |
| 2004/0053751 | A1 | 3/2004 | Pizolato |
| 2005/0008992 | A1 | 1/2005 | Westergaard et al. |
| 2005/0209064 | A1 | 9/2005 | Peterson et al. |
| 2006/0229163 | A1 | 10/2006 | Waters |
| 2007/0004565 | A1 | 1/2007 | Gebhardt |

* cited by examiner

BICYCLE TRAINER WITH VARIABLE RESISTANCE TO PEDALING

FIELD OF THE INVENTION

The invention relates to the field of bicycle trainers for temporarily attaching a bicycle to a frame and for providing variable resistance to pedaling during a training course.

BACKGROUND OF THE INVENTION

Bicycle trainers have been used in various forms for many decades. Early versions of stationary bicycles allowed a user to pedal on a stand for exercise. See U.S. Pat. No. 4,958,832 (Kim 1990). Over time, technology has progressed to a point where stationary bicycles are computerized for various training options. The computerized exercise equipment allows a rider to simulate hills by adjusting the position of the bicycle and to vary resistance to pedaling via a control system attached to the gears in place on the equipment. One problem with stationary bicycles is that each user has to adjust the settings for their own preferences. Additionally, the stationary bicycle must come in a one-size-fits-all version, meaning that the user has limited options in features such as seat style and tire size.

Over time, the market increased to a point where individualized trainers have been developed, allowing users to attach their personal bicycle to a portable trainer. For example, one brand that has been successful to date is known as CycleOps®. The CycleOps® incorporates a means of adding resistance to the back tire revolution and thereby varying the resistance to pedaling a temporarily attached bicycle.

U.S. Patent Application Nos. 2004/0053751 (Pizolato 2004) and 2005/0209064 (Peterson 2005) disclose modern style bicycle trainers that attach to the back tire of a standard bicycle. The Pizolato '751 application provides a connection to the rear axle of a bicycle with latitude for side to side movement when the rider faces an increased resistance to pedaling. An electrical control generator provides the resistance to pedaling. The Peterson '064 application provides a rear tire mount but requires removing the front tire to exercise on the bicycle. Springs at the back of the trainer provide a righting force when the user stands to pedal. Peterson discloses fluid-filled cylinders, magnetic assemblies, and airflow devices to control the resistance to pedaling.

Other developments in bicycle trainers include mechanisms for adjusting the front tire of a bicycle during trainer exercises. U.S. Pat. No. 7,083,551 (Lassanske 2006) provides a mechanical apparatus for lifting the front tire of a bicycle connected to a trainer frame at the back tire. The Lassanske patent, however, requires the user to manually place the front tire of the bicycle in a one of several select positions at different heights. Generally, the Lassanske device uses a pedestal for raising the front end of the bicycle via several support members.

U.S. Patent Application No. 2007/0004565 (Gebhardt 2007) provides a more extensive combination of trainer options by attaching the rearward driven tire on the bicycle to a trainer frame with a resistance device pressing against the back tire. The front of the trainer lifts the bicycle up and down, and the front and back parts of the trainer are electronically controlled for a more realistic riding experience. In preferred embodiments, the Gebhardt patent application utilizes linear actuator motors electronically controlled by a common signal to determine the height of the front tire lift and the resistance of the resistance device. Gebhardt also connects the front tire lift and rear tire resistance via cabling, bearing assemblies, and mechanical linkage assemblies. Gebhardt adjusts the rear tire position during front tire elevation changes only by an apparently stationary axle clamp.

More modern bicycle trainers also include electronics to control the tire position and resistance to pedaling in a training scenario. U.S. Patent Application No. 2002/0055422 (Airmet 2002) discloses a training apparatus for temporarily attaching a standard bicycle to a trainer controlled by electronic inputs. The trainer simulates an environment where the operator experiences three-dimensional motion and pedaling resistance similar to that of riding a real bicycle. The resistance to pedaling is a variable electromagnetic resistor controlled by input from interactive data received from an associated control system. The rear tire of the bicycle is held in place by axle locking mechanisms that are fixed in place. A rocker assembly allows the bicycle to simulate turns by tilting the bicycle left and right at angles that are in accordance with the rider's position and commands from the control system. The Airmet '422 application, however, provides no way to adjust the front tire elevation or any adjustments to front and back translation of the bicycle.

Other trainers with electronic components connected thereto include U.S. Patent Application No. 2003/0073546 (Lassanske 2003)(showing a generator connected to the rear tire for powering the trainer components); 2005/0008992 (Westergaard 2005); and 2006/0229163 (Waters 2006). Each of these publications includes components necessary for electronically controlling a bicycle's position on a trainer. While these documents show various combinations of front tire and rear tire lifts that a rider can use to maneuver a bicycle in a simulated training circuit, none of these embodiments provides for new ways of controlling the resistance element engaging the back tire. Furthermore, none of these published patent applications provides for any forward and backward translation of the bicycle during times of raising and lowering the front tire.

Accordingly, there exists a need in the art of bicycle trainers for an apparatus that allows for electronic simulation of real world bicycle courses in a stationary trainer. The trainer preferably includes improved mechanisms for applying resistance to the rear bicycle tire and allows for limited bicycle movement that is still sufficient to provide a more realistic training experience.

BRIEF SUMMARY OF THE INVENTION

The invention is a bicycle trainer to which a standard bicycle temporarily attaches for exercise and simulated rides. A lifting mechanism raises and lowers the front tire, and in preferred embodiments, a frame engages the rear tire to hold the rear tire in an elevated position against a resistance cylinder. The resistance cylinder provides a force against rear tire revolution. In one preferred embodiment, the trainer is characterized by the frame including rear tire supports that allow the bicycle to translate forward and backward as necessary to simulate uphill and downhill riding courses. In this embodiment, translation of the bicycle creates variable resistance as a function of the rear tire pressure against the frame's resistance cylinder.

The forward/backward translation of the bicycle is necessary during training maneuvers that include raising and lowering the front tire. In a preferred embodiment, the forward and backward movement is made possible by rollers temporarily attached to the rear bicycle tire axle and the trainer frame. The rollers, and therefore the bicycle as well, are allowed limited forward and backward movement to enhance the simulated riding experience as the front end of the trainer raises up and down.

In other preferred embodiments, the trainer includes a selection of mechanisms for controlling the amount of resistance applied to the rear tire. As noted above, one source of rear tire revolution is a resistance cylinder against which the rear tire turns. The resistance cylinder may incorporate a resistance fluid to provide variable resistance to rear tire movement.

The resistance fluid in the cylinder provides an opportunity for additional control of the resistance to pedaling. The resistance to pedaling may be determined by the volume of resistance fluid in the cylinder. In this embodiment, the cylinder may include baffles that turn within the fluid in direct response to pedaling the back tire (i.e., the more fluid in the cylinder, the more resistance the baffles encounter). In one preferred embodiment, the volume of resistance fluid changes by pumping the resistance fluid into and out of a reservoir associated with the resistance cylinder.

Pumping the resistance fluid into and out of the reservoir allows additional embodiments of the invention. For example, dual pumps may be used to displace a high density resistance fluid in one direction while adding a lower density resistance fluid from an opposite end of the reservoir. The density of the resistance fluid, therefore, provides another means of controlling the resistance faced by the baffles turning within the resistance fluid.

In another embodiment, the rear tire resistance is controlled by a tilting mechanism that allows the body of the bicycle to tilt back and forth against the resistance cylinder as the front tire is lifted up and down. The pivoting of the bicycle about this tilting mechanism creates a variable resistance as a function of rear tire pressure against the cylinder attached to the trainer. In other words, the bicycle is lifted in front and allowed to traverse an arcuate path to provide varying pressure of the back tire against the resistance cylinder.

The invention disclosed herein further includes other mechanisms for controlling the resistance that the back tire encounters during a work out. The resistance cylinder may be controlled by cabling that loosens and tightens in accordance with the front lifting mechanism operation. The resistance cylinder may also engage the back tire at various pressure levels controlled by hydraulic lifts or even a lever having ends that are controlled by a common energy source.

DETAILED DESCRIPTION

Figure 1A:
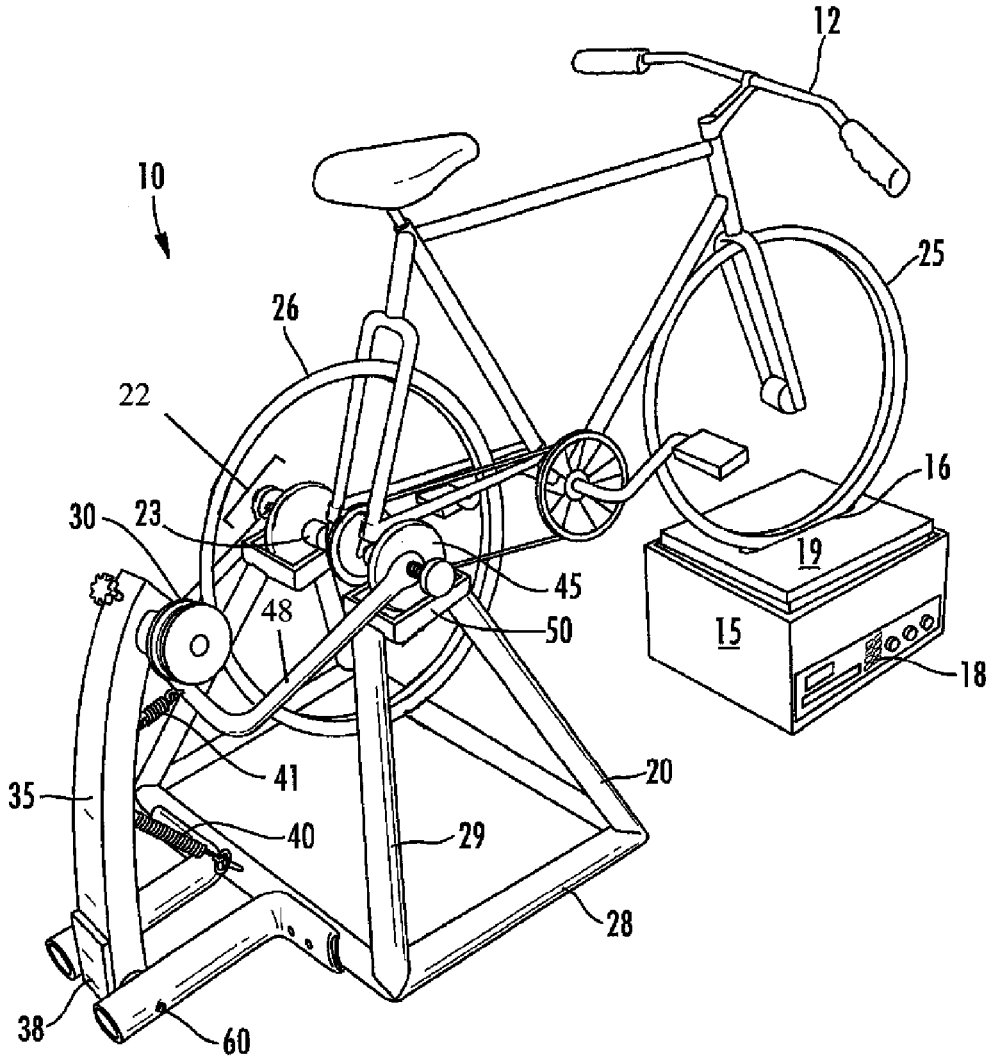
FIG. 1A is a perspective view of a bicycle trainer having a front lifting mechanism and allowing for forward and backward translation in accordance with this invention.

The invention is a bicycle trainer (10) that provides variable resistance to pedaling and allows for a rider to simulate a real-world bicycle course, including maneuvering up and down hilly terrain. Overall, the trainer (10) engages both the front tire (25) and the back tire (26) of the bicycle (12) and adjusts each according to the rider's preferences for training. One useful aspect of the disclosed trainer is its ability to accommodate an individual's personal bicycle (12). In other words, the trainer (10) does not include built-in biking equipment but lets a rider use his own bicycle (12) in a training situation.

The invention includes diverse mechanisms for controlling the resistance to pedaling that a user encounters when using the trainer (10). Each embodiment of the trainer includes parts and mechanisms that are interchangeable among each other. In other words, the invention is not limited to specific embodiments of the invention as set forth in the drawings and claims, but each embodiment may utilize features from the other embodiments. Furthermore, each embodiment and combination of the invention described herein incorporates standard electrical circuitry and computerized systems that are known in the art of control systems. The drawings schematically represent the portions of the device that enable full utilization, but the drawings are not intended to limit the invention to any particular arrangement for standard electrical components (i.e., power circuits, control circuits, cables, and associated connectors).

Figure 1B:
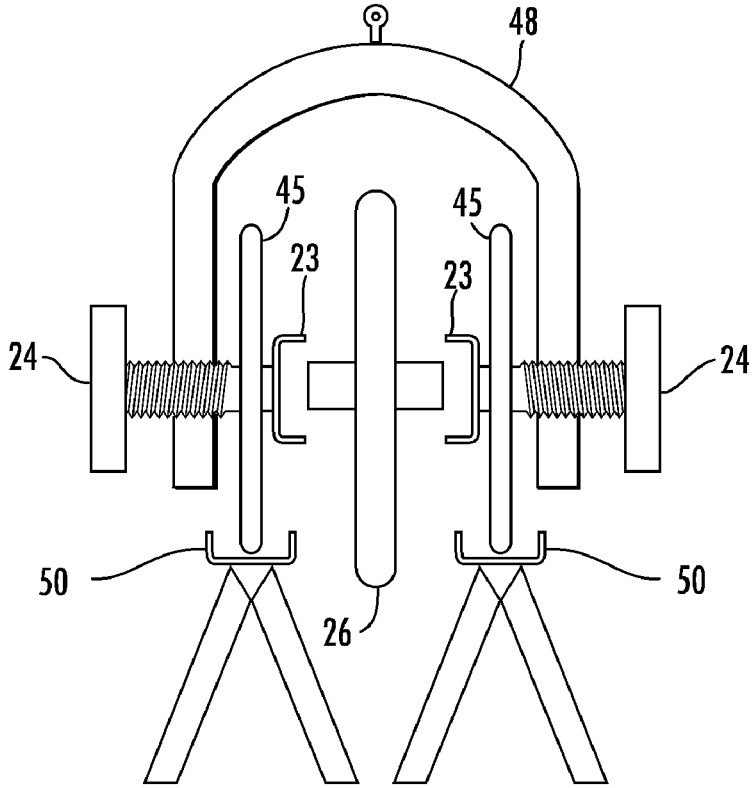
FIG. 1B is a rear view of the trainer of FIG. 1 and shows the mechanics of the bicycle rear tire axle connection.
Figure 1C:
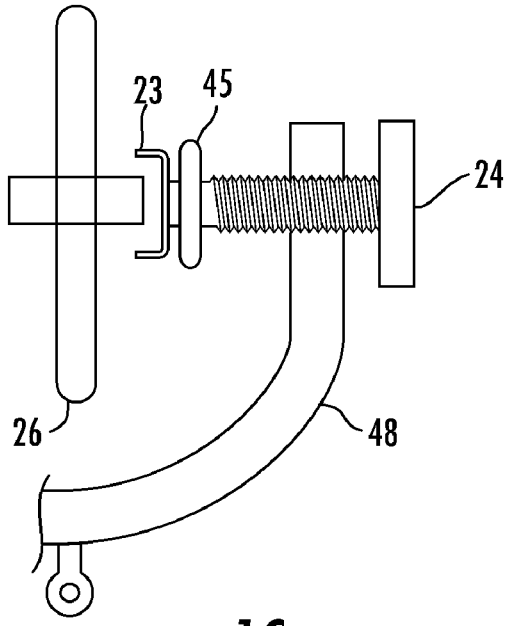
FIG. 1C is a close-up view of the axle connection of FIG. 1B.

In the embodiment of FIGS. 1A-1C, the trainer (10) includes a lifting mechanism (15) engaging the front tire (25) of the bicycle (12). The lifting mechanism (15) is adapted to raise and lower the front tire (25) of the bicycle (12) to simulate a course over a hilly terrain. The lifting mechanism (15) includes a front platform (19) on which the front tire (25) of the bicycle rests. Hydraulic mechanisms known in the art today provide options for raising and lowering the front of the bicycle (12). Other mechanical lifts that use electric motors in appropriate combination with movable parts can also be used in certain embodiments. One embodiment of the lifting mechanism is discussed in regard to FIG. 8B, infra., but that figure in now way limits the automatic and controllable front tire lifting mechanisms available for use.

To ensure that the bicycle (12) is steady during the lifting and lowering motions, the platform (19) may include a groove or slot (16) in which the front tire (25) remains during the training exercise. A securing mechanism (not shown) is available to hold the front tire (25) in place. Options for the securing mechanism include a rod or pin that engages the lifting mechanism (15) and crosses over a portion of the front tire (25) (through the spokes) to the other side of the lifting mechanism (15).

The trainer (10) also incorporates a bicycle-holding frame (20) that, in a preferred embodiment, holds the rear tire (26) of the bicycle (12). The frame (20) incorporates a rear tire support (22) that lifts the rear tire (26) off the ground or floor and simultaneously allows the bicycle (12) to translate forward and backward as the lifting mechanism (15) raises and lowers the front tire (25). The frame (20) further includes a resistance cylinder (30) attached to the frame (20) and pressing against the rear tire (26) for providing a source of resistance to the rear tire (26). A resistance fluid (not shown) fills the resistance cylinder (30) and baffles (215) in the resistance cylinder (30) rotate within the resistance fluid as the bicycle rear tire's revolution turns the resistance cylinder (30). The baffles (215) within the resistance fluid resist cylinder revolution, adding to the intensity of the workout on the trainer (10).

The overall resistance that the rider faces on the trainer (10) is determined predominantly, however, by the pressure of the rear tire (26) against the resistance cylinder (30). This pressure, in turn, is determined by the height of the lifting mechanism (15) at any given time. In other words, when the lifting mechanism (15) raises the front tire (25) to a maximum height, the rear tire (26) braces against the resistance cylinder (30) to the maximum extent possible because the bicycle (12) translates backward to the farthest rearward position. When the lifting mechanism (15) is in its lowest position, the force of the rear tire (26) against the resistance cylinder (30) is at a minimum. Accordingly, the lifting mechanism (15) allows the rider to simulate an extreme uphill climb or a less difficult flat or downhill ride.

Allowing the bicycle (12) to translate forward and backward provides the trainer (10) with a way of modulating the force of the rear tire (26) on the resistance cylinder (30). In one embodiment, the frame (20) incorporates the necessary parts to provide a rear tire (26) support for lifting the rear tire (26) to a constant elevated position. In a preferred embodiment, the rear tire support (22) includes a pair of caps (23) for engaging the rear tire axle on either side. The caps (23) are configured to engage rollers (45) that provide forward and backward translation as the lifting mechanism (15) raises the front tire up and down.

A U-bar (48) or other bracket surrounds the rear tire (26) and the rear tire support (22) to hold the rear tire (26) and the rear tire support (22) in place. FIG. 1 shows the U-bar (48) connected to the frame (20) at the trainer bar (35) by the constant pressure spring (40). As shown in FIG. 1, the U-bar may be disconnected from the trainer (10) and remain attached to the rear tire axle (27) via the cap-roller-screw assembly (23, 45, 24 respectively). The use of a removable U-bar makes the trainer more modular and gives additional options for storage. For example, the user might prefer to leave the U-bar-screw-roller-cap assembly attached to the bicycle (12) and hang the bicycle by the U-bar. The U-bar (48) might also provide an attachment point for transporting the bicycle (12) on top of a vehicle or in a bicycle rack. In this embodiment, the U-bar remains rotatably pivoted about the bicycle rear tire axle (27) for added functionality.

For riders who prefer fewer parts to assemble on the trainer, the U-Bar (48) may be welded or attached by screws to the trainer (10). This embodiment requires the U-bar (48) to remain stationary and attached to the frame (20) even when the bicycle (12) is not positioned on the trainer.

A pair of translational platforms (50) give the rear tire (26) a surface on which the bicycle (12) can move forward and backward as necessary during the lifting of the front tire (25). To achieve the forward and backward translation, the trainer (10) accommodates rollers (45), as noted above, attached to the rear tire axle (27) of the bicycle (12). The rollers (45) engage the translation platforms (50) and allow the bicycle (12) to move back and forth as the lifting mechanism (15) moves up and down. In other words, the translation platforms (50) indirectly control the extent to which the bicycle (12) moves toward or away from the resistance cylinder (30) when the height of the front tire (25) is changing with the position of the lifting mechanism (15). Again, to ensure that the overall trainer (10) is stable, the trainer frame (20) includes appropriate mechanisms for supporting the rear tire (26) during times of movement. The frame (20) includes the option of a U-bar (48), or any U-shaped bracket, for securing the rollers (45) to the axle and holding the rear tire (26) steady when attached to the frame (20).

The trainer frame (20) includes a base (28) that engages the floor or the ground and support rods (29) that lift the rear tire (26) of the bicycle (12) to a desired elevation. In one embodiment, the support rods (29) lift the rear tire (26) to an elevation that allows the front tire (25) lifting mechanism (15) to simulate both uphill and down hill bicycle course. FIG. 1B shows a rear view of the elevated rear tire (26) connected at the rear tire axle (27) to the trainer (10). A pair of screws (24) hold the rear tire (26) in its elevated position on the translation platforms (50). The screws (24) extend through the U-Bar (48) and through the translating rollers (45). The screws terminate at caps (23) that grip the rear tire axle (27) and hold the rear tire in the elevated position. FIG. 1C shows a close-up view of the same configuration.

The trainer frame (20) is generally stationary and allows movement of the associated bicycle (12). As noted above, the resistance to pedaling is determined by the amount of force with which the rear tire (26) engages the resistance cylinder (30). To ensure a minimum amount of force at all times, the trainer (10) attaches via a retraction spring (41) to the U-bar (48) holding the rear tire support (22) mechanisms in place. The tension in that spring (41) determines the absolute minimum amount of contact between the resistance cylinder (30) and the rear tire (26). In a preferred embodiment, the retraction spring (41) is biased to pull the rear tire (26) toward the resistance cylinder (30). In other embodiments, the retraction spring may be adjustable (i.e., attached by a threaded screw or other mechanism allowing for adjustment to the spring's span).

In another preferred embodiment of the trainer (10), the resistance cylinder (30) is at least partially filled with resistance fluid for providing variable resistance to rear tire (26) movement, wherein the resistance is a function of (i) increased or decreased volume of resistance fluid in the resistance cylinder (30), (ii) the density of the resistance fluid, (iii) the force with which the rear tire (26) engages the resistance cylinder (30); or (iv) combinations of (i) to (iii). In one embodiment, the resistance to pedaling is controlled predominantly by the resistance fluid (i.e., the resistance to pedaling the back tire (26) is determined by (i) increased or decreased volume of resistance fluid in the resistance cylinder (30); or (ii) the density of the resistance fluid; or (iii) a combination of (i) and (ii)).

Controlling resistance to pedaling at the point where the rear tire (26) engages the resistance cylinder (30) is also affected by a constant pressure spring (40). The constant pressure spring (40) biases the resistance cylinder (30) toward the rear tire (26) of the bicycle (12). In a preferred embodiment, the resistance cylinder (30) is positioned on a trainer bar (35) that extends from the base (28) of the trainer frame (20). The trainer bar (35) generally curves inwardly in a substantially vertical rise toward the translation platforms (50). The trainer bar (35) is attached to the base (28) of the trainer frame (20) at its lower end via a pivoting bolt (60) that allows the trainer bar (35) latitude of arcuate movement about the lower pivot point (60). The constant pressure spring (40) pulls the trainer bar (35) downward toward the base (28) by connecting to the underside of the trainer bar (35) and the back end of the base (28) of the trainer frame (20). The constant pressure spring (40) thereby biases the resistance cylinder (30) toward an attached bicycle (12).

Figure 2A:
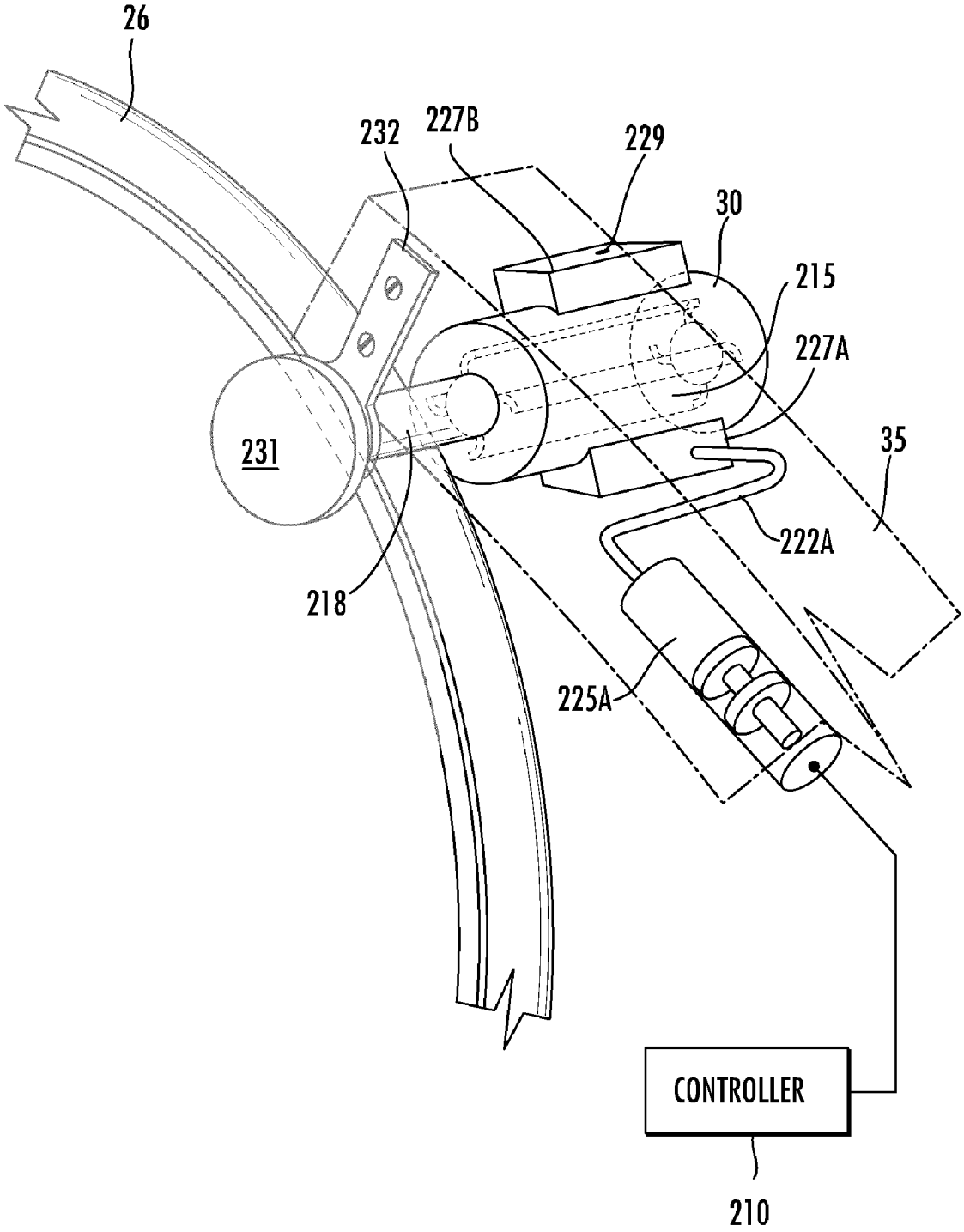
FIG. 2A is a close up view of a resistance cylinder with resistance fluid pumped into and out of the cylinder in accordance with the disclosure of this invention.
Figure 2B:
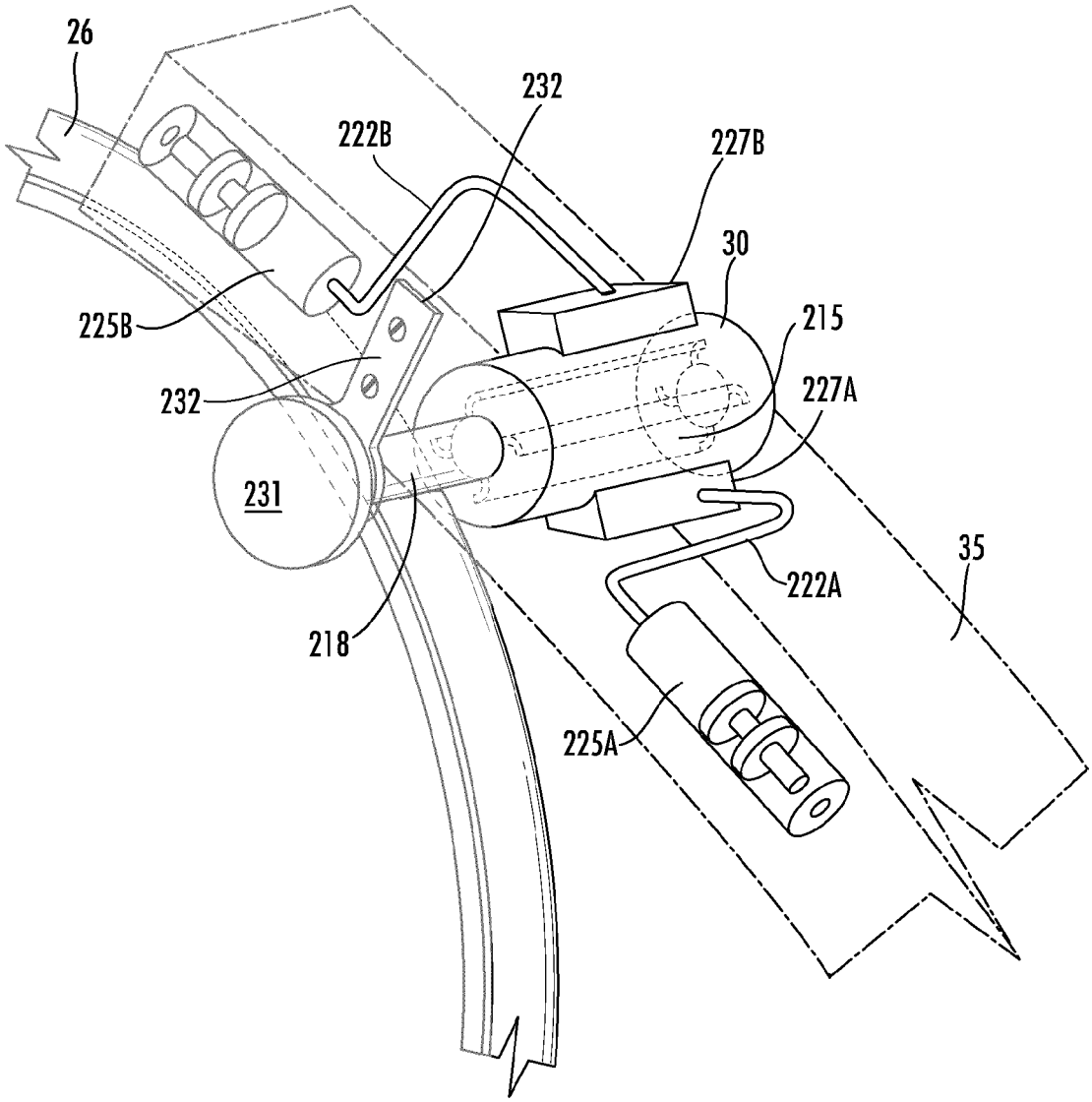
FIG. 2B is a close up view of a resistance cylinder with resistance fluid pumped by two pumps on opposite sides of the resistance cylinder for a completely closed loop operation.

As noted above, resistance to pedaling can be controlled in four generally different ways—(i) increased or decreased volume of resistance fluid in the resistance cylinder (30), (ii) the density of the resistance fluid, (iii) the force with which the rear tire (26) engages the resistance cylinder (30); or (iv) various combinations of (i) to (iii). In a preferred embodiment, the trainer (10) includes a mechanism for controlling the resistance to rear tire revolution at the point of the resistance cylinder (30). As shown in FIGS. 2A and 2B, one embodiment of the trainer (10) incorporates a resistance cylinder (30) with mechanisms for controlling the amount of resistance to turning the cylinder.

In this embodiment (FIG. 2A), the resistance fluid can be pumped into the resistance cylinder (30) and out of the resistance cylinder (30) for more or less resistance, respectively. As known in the art of bicycle trainers, one way of imparting resistance to tire revolution is by controlling the magnitude of the resistant force imparted by the resistance cylinder (30) onto the rear tire (26). The resistance cylinder (30), for example, may include a fly wheel with baffles (215) that paddle against the resistance fluid when the resistance cylinder (30) turns. In this embodiment, the density of the resistance fluid affects the ease with which the paddles, or baffles (215), move through the fluid. The volume of resistance fluid in the resistance cylinder (30) also affects the force required for the wheel to turn.

In a most preferred embodiment, the trainer (10) includes a mechanism for pumping the resistance fluid into and out of the resistance cylinder (30). In this way, the trainer (10) has the ability to vary the resistance to pedaling in proportion to the amount of resistance fluid in the resistance cylinder (30). The pumping mechanism can be any of the numerous pumps (225A, 225B) known in the industry today. In FIG. 2A, one example includes a syringe pump (225A) that moves resistance fluid through tubing (222A) into a reservoir (227A) attached to the resistance cylinder (30). The reservoir (227A) is useful to control the amount of resistance fluid in the resistance cylinder (30) at any given point. An air valve (229) associated with the resistance cylinder (30) allows for the removal of air during times of filling the reservoir (227A), and the pump (225A) maintains a vacuum during times of removing resistance fluid from the reservoir (227A). In the embodiment of FIG. 2A, the resistance cylinder (30) includes a resistance cylinder axle (218) that engages the rear tire (26) of the bicycle (12). As the rider pedals the bicycle (12), the rear tire (26) turns the resistance cylinder axle (218), which in turn rotates the resistance cylinder baffles (215) against the resistance fluid. Accordingly, the resistance cylinder (30) provides resistance to pedaling in direct relation to the amount of resistance fluid in the cylinder (30).

Embodiments of the resistance cylinder (30) utilizing a pump (225) allow for additional versions of the trainer. Without limiting the invention to any one resistance cylinder (30), the invention includes embodiments that pump more than one kind of resistance fluid into and out of the reservoir (227). For example, the reservoir of FIG. 2A includes two portions—a lower portion (227A) and a higher portion (227B). In an embodiment utilizing two pumps, as shown in FIG. 2B, the first pump (225A) may be attached to the lower reservoir portion (227A) and a second pump may be attached to the higher reservoir portion (227B). The first pump (225A) may pump a high density fluid into the resistance cylinder (30), and the second pump (225B) may pump a lower density resistance fluid into the resistance cylinder (30). With the two pumps controlled by a common resistance controller (210), the resistance to pedaling is proportional to the amount of higher and lower density resistance fluids in the cylinder (30).

FIG. 2B shows a close-up view of the resistance cylinder with the two-pump configuration. In FIG. 2B, a controller (210) may coordinate movement of low-density resistance fluid to and from one pump (225B) simultaneously with the control of high density resistance fluid pumped in and out of the second pump (225A). Of course, electronic connections to the computerized system described herein are inherent in FIGS. 2A and 2B. Without limiting the invention in any way, however, embodiments of the invention may utilize portions of the trainer bar (35) itself for components such as the reservoirs (227A, 227B). In other words, the pump-reservoir system may be integral with the trainer bar (35) as opposed to being the separate pieces of FIGS. 2A and 2B.

The resistance fluid of this invention can be any stable fluid used in the art of bicycle trainers for providing resistance to rear tire revolution. Without limiting the invention to any particular resistance fluid, various grades of oil, polymer compositions, water-based emulsions, and other fluids can be used. The entire pumping mechanism may be attached to the trainer bar (35) as shown in FIGS. 2A and 2B with a bracket (232) and a capping device (231) retaining the resistance fluid therein.

Figure 4:
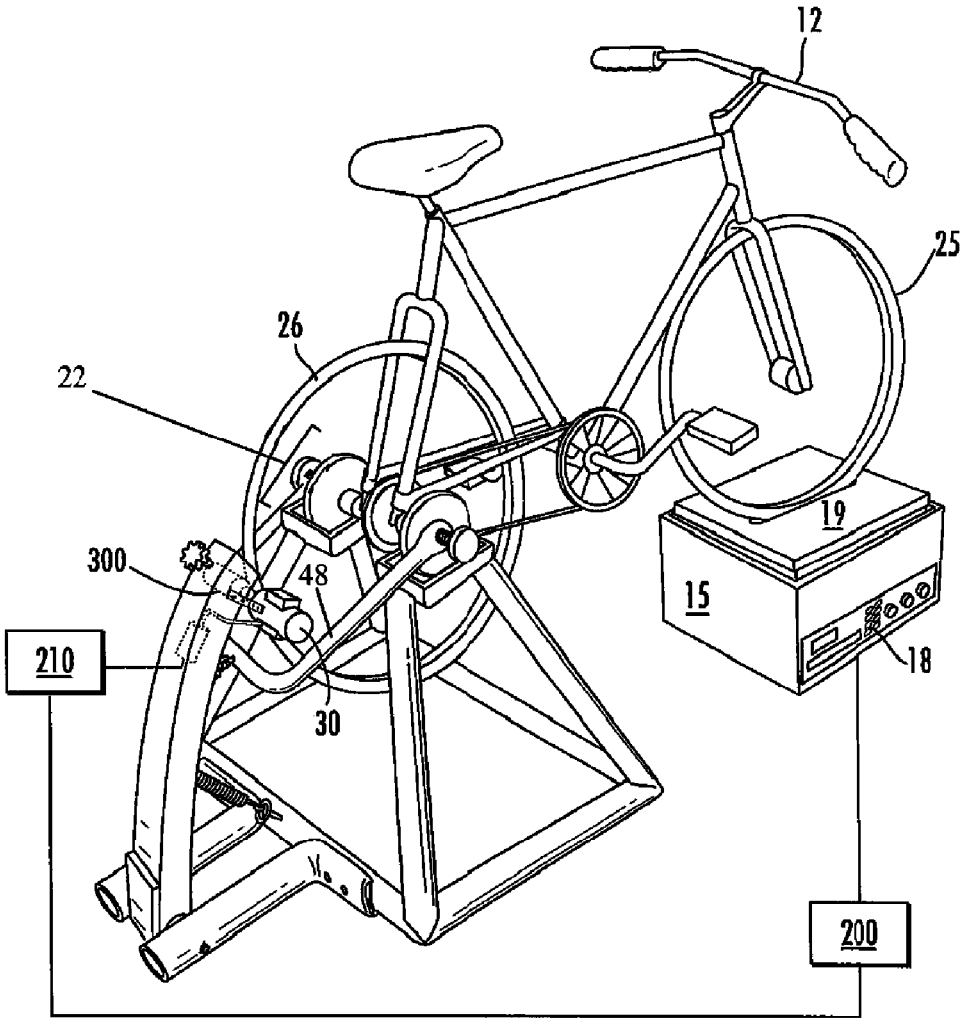
FIG. 4 is a perspective view of the trainer with the generator and resistance cylinder of FIG. 3.

The trainer (10) disclosed herein is directly compatible with electronic control systems that coordinate the training experience preferred by the rider. Each embodiment disclosed herein is entirely compatible with an electronic control system, but one overall example is shown in FIG. 4. As noted above, the lifting mechanism (15) may include electronics in data communication with a control module (200). The control module (200) preferably includes computerized instructions in a sequence that directs the lifting mechanism (15) to raise and lower the front tire (25) according to a set of previously programmed instructions. For example, the instructions may simulate a preferred route that actually exists in a real-world geographical location. In a most preferred embodiment, the trainer is connected to a computerized player that utilizes data to simulate a desired training route. One example, as shown in FIG. 1, is a CD player with the CD including computerized data for simulating a desired course.

The control module (200) associated with the trainer (10) electronically connects the height controller (18) of the lifting mechanism (15) with a resistance controller (210) connected to the resistance cylinder (30) for a unified approach to a planned training session. The control module (200), then, incorporates a computerized method of simulating a training circuit on a bicycle (12) by electronically connecting the height controller (18) that modulates the front tire (25) lifting height and the resistance controller (210) that directs a pump (225) to move resistance fluid into and out of the resistance cylinder (30) in real time.

Figure 3:
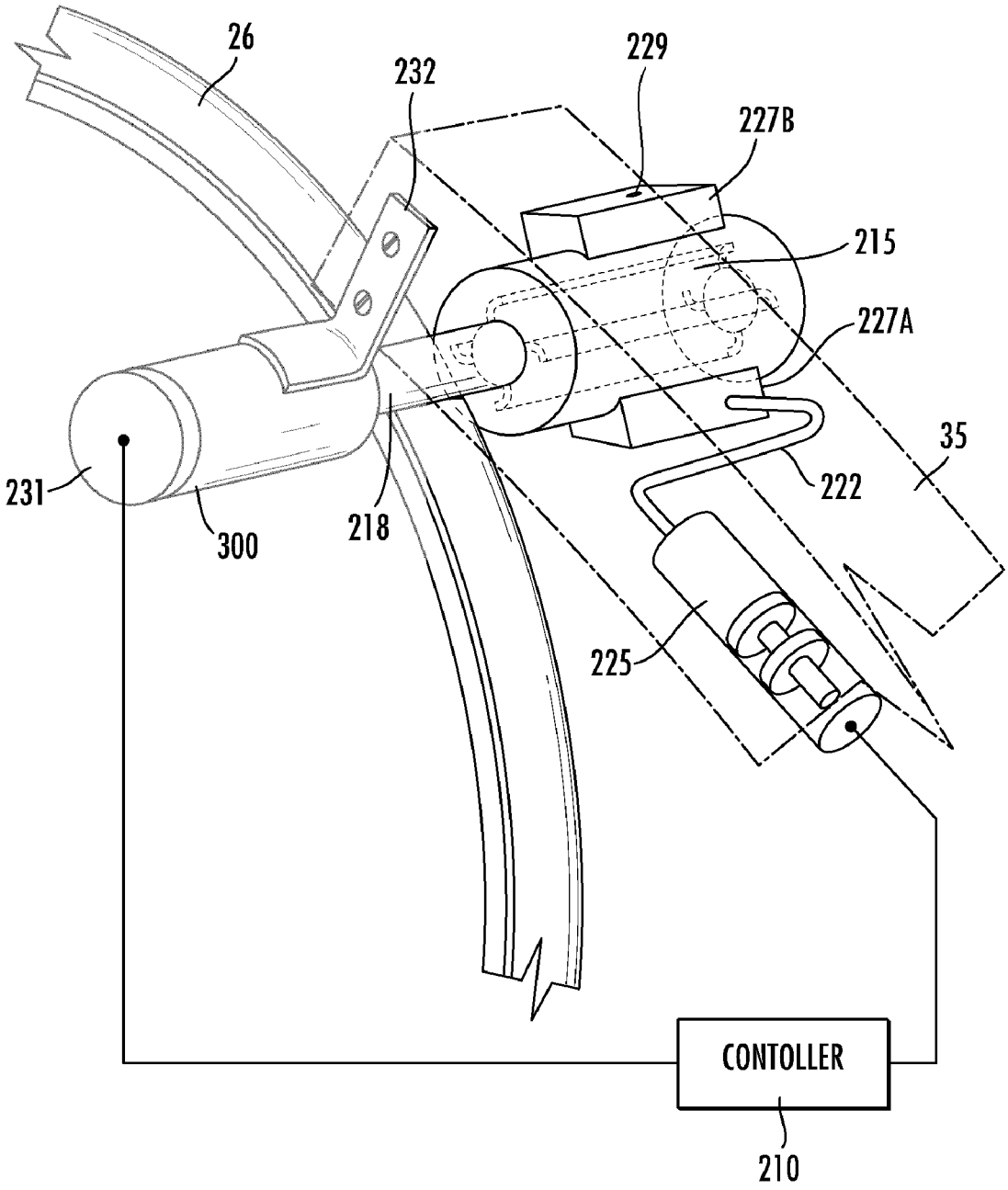
FIG. 3 is a close up view of the resistance cylinder of FIG. 2A with the addition of an electrical generator in accordance with the invention herein.

The trainer (10) described herein also embodies a means of generating its own power for situations in which electricity is either unavailable or undesirable. One option, of course, is to incorporate battery power into the trainer design. Another option is the use of a generator to provide electrical power to the trainer components. The generator (300), shown in FIG. 3, is also attached to the resistance cylinder axle (218) shown in FIG. 2. As the rear tire (26) revolves about the rear tire axle (27), corresponding revolutions of the generator (300) enable the generator (300) to produce electrical power. Generators (300) are known in the art today and are becoming more prevalent among those who choose to control energy costs in various applications. In the embodiment of FIGS. 3 and 4, the generator (300) is attached to the trainer bar (35) by a bracket (232) to assist in holding up the resistance cylinder/resistance cylinder axle/pump/generator assembly. In a preferred embodiment, the generator (300) provides power to the electronics incorporated into this invention. In this embodiment, the generator (300) is electronically connected to the control module (200), the height controller (18) of the lifting mechanism (15), and the resistance controller (210) attached to the pump (225) of the resistance cylinder (210).

FIG. 4 shows a perspective view of one embodiment of the trainer (10) with an associated bicycle (12) ready for use. The bicycle is removably attached to the trainer, allowing the user to ride personally owned equipment with which they are familiar. The embodiment of FIG. 4 includes the same features described above in regard to FIGS. 1-3. In a preferred embodiment, the trainer (10) may exclude the translation platforms (50) discussed above. In other words, certain embodiments of the invention work well when the rear tire (26) of the bicycle (12) engages the trainer (10) in a fixed position that does not allow forward and backward translation. This embodiment allows the bicycle (12) to pivot around its axle, secured to the trainer (10), as the lifting mechanism (15) moves the bicycle (12) front tire (25) up and down.

Figure 5A:
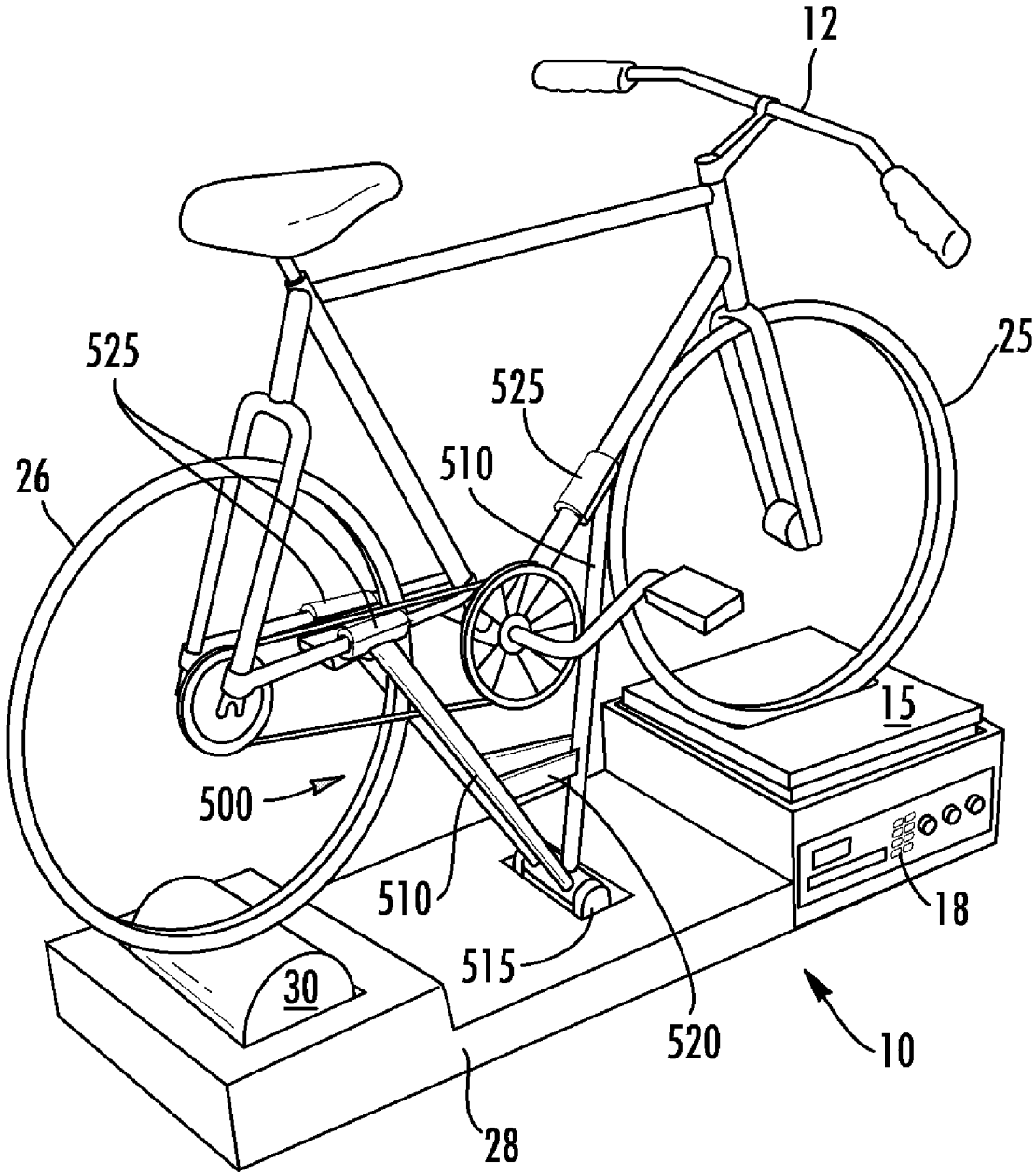
FIG. 5A is a perspective view of a trainer having a tilting mechanism for allowing arcuate movement of an attached bicycle in accordance with the disclosed invention.
Figure 5B:
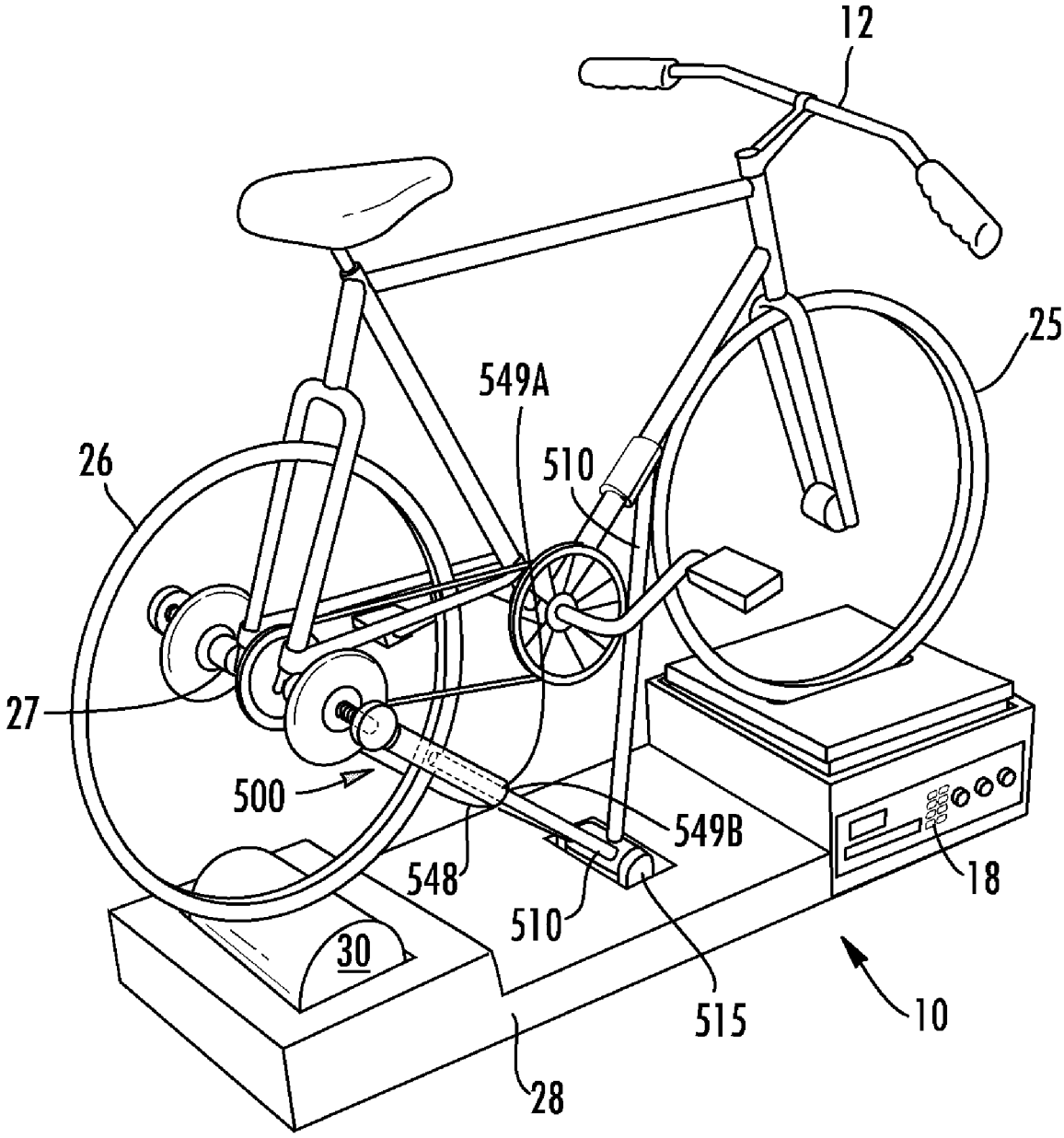
FIG. 5B is a perspective view of a trainer having a tilting mechanism attached to the bicycle axle by a U-Bar connector.

The embodiment of FIGS. 5A and 5B provides yet another embodiment of a bicycle trainer according to this invention. FIG. 5A shows a trainer (10) with an associated frame in the form of a substantially flat base (28). The front of the base (28) incorporates a lifting mechanism (15) in accordance with FIGS. 1 through 4 above. The back of the base (28) includes the resistance cylinder (30) biased to engage the rear tire (26) of the bicycle (12), possibly by an engagement spring installed in the base (28).

The trainer frame of FIG. 5A is characterized by a tilting mechanism, referred to as a frame connector (500), enabled by pivoting support rods (510) extending outwardly (substantially vertically) from the trainer base (28). The support rods (510) attach at one end to a pivot bar (515) attached to the base (28) in a way that allows the pivot bar (515) to rotate about its longitudinal axis. In certain embodiments, the support rods (510) are hinged to the pivot bar (515) in a way that allows their circular movement about the pivot bar (515) to be adjusted or personalized for different sizes of bicycles and users. In embodiments using a hinged set of support rods (510), an adjustable cross bar (520) stabilizes the support rods (510) in a preferred position. The adjustable cross bar (520) in combination with hinged support rods (510) allows variable sizing of the angle formed between the support rods (510). This variable sizing allows for different sized bicycles to be used on the trainer (10). In any case, the support rods (510) extend upwardly and engage the bicycle (12) body. In a preferred embodiment, the support rods (510) terminate in support cups (525) that attach to the metal bars of the bicycle body for a stable training session.

As the lifting mechanism (15) shown in FIG. 5 moves the front tire (25) of the bicycle (12) up and down, the pivot bar (515) rotates the support rods (510) in a way that moves the bicycle body in an arcuate path. As the front lifting mechanism (15) moves up and down, the rear tire (26) of the bicycle (12) engages the resistance cylinder (30) at the back end of the base (28). The extent of the arcuate path can be determined by the length of the support rods (510), by a stopping mechanism attached to the sides of the pivot bar (515), or by the length of the adjustable cross bar (520). The support cups (525) attached to the body of the bicycle (12) are substantially stationary and engage the bicycle body with enough force to hold the bicycle (12) steady during up and down movement.

Figure 5C:
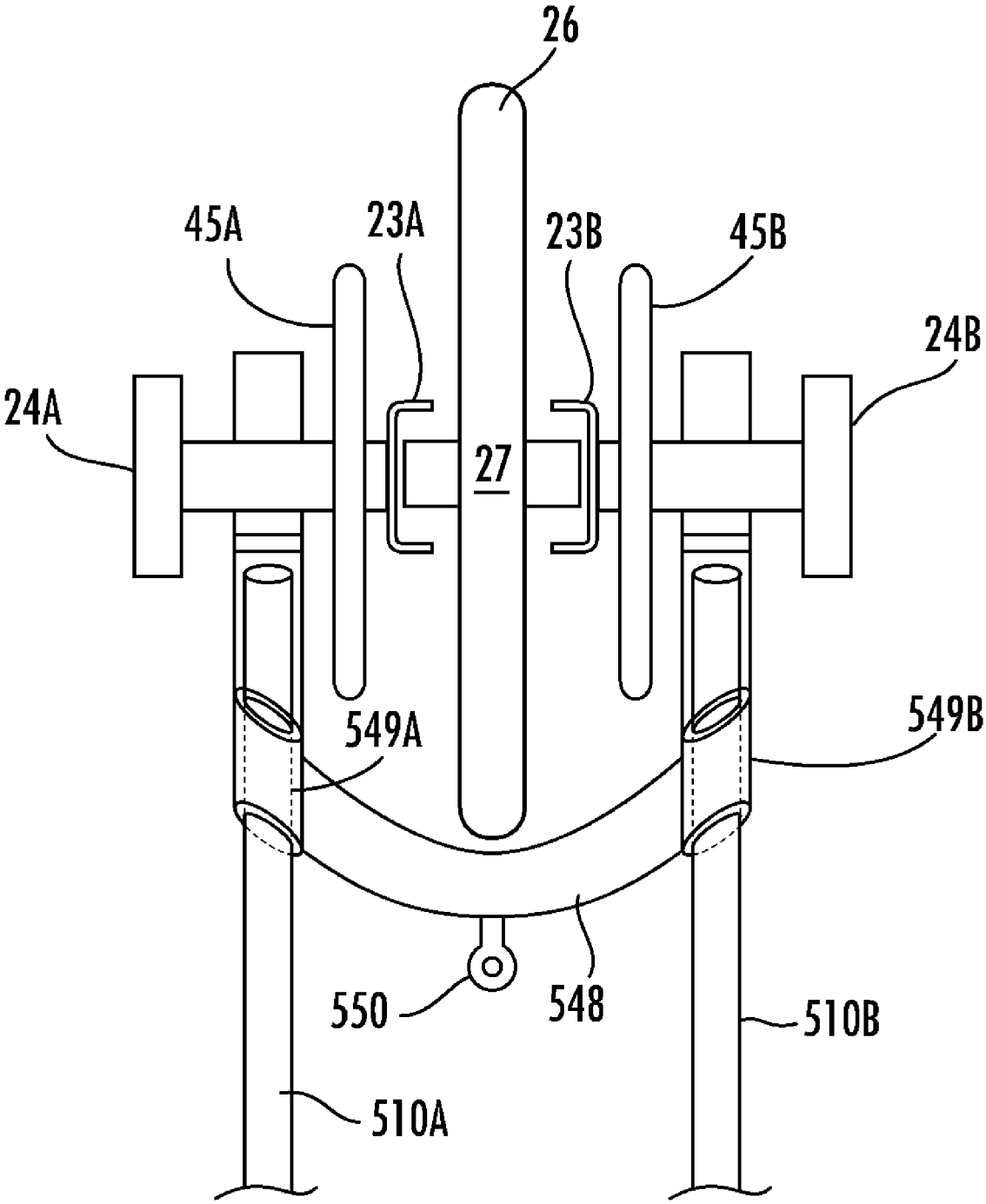
FIG. 5C is a rear view of the tilting mechanism of FIG. 5B with the U-Bar connector attached to the bicycle rear axle.

FIG. 5B shows yet another modification to the trainer (530), similar to that of FIG. 1, Ref. 48. In the embodiment of FIG. 5B, the U-Bar (548) allows for the support rods (510) to connect to the rear tire axle (27). The U-Bar engages the support rods (520) on one end via hollow bores (549A, 549B). The other end of the U-Bar (548) connects to the rear tire axle (27) in the same way as FIG. 1. FIG. 5C shows a closer view of the tilting mechanism embodiment with support rods (510A, 510B) engaging hollow bores (549A, 549B). U-Bar (548) connects to the rear tire (26) with respective caps (23A, 23B) engaging both ends of the rear tire axle (27). The caps (23) are removably attached to rollers (45A, 45B), and the whole assembly is tightened with screws (24A, 24B). Connector (550) allows for the U-Bar to be attached to the trainer via a spring (not shown), and of course, the U-Bar is removable at the option of the rider.

Figure 5D:
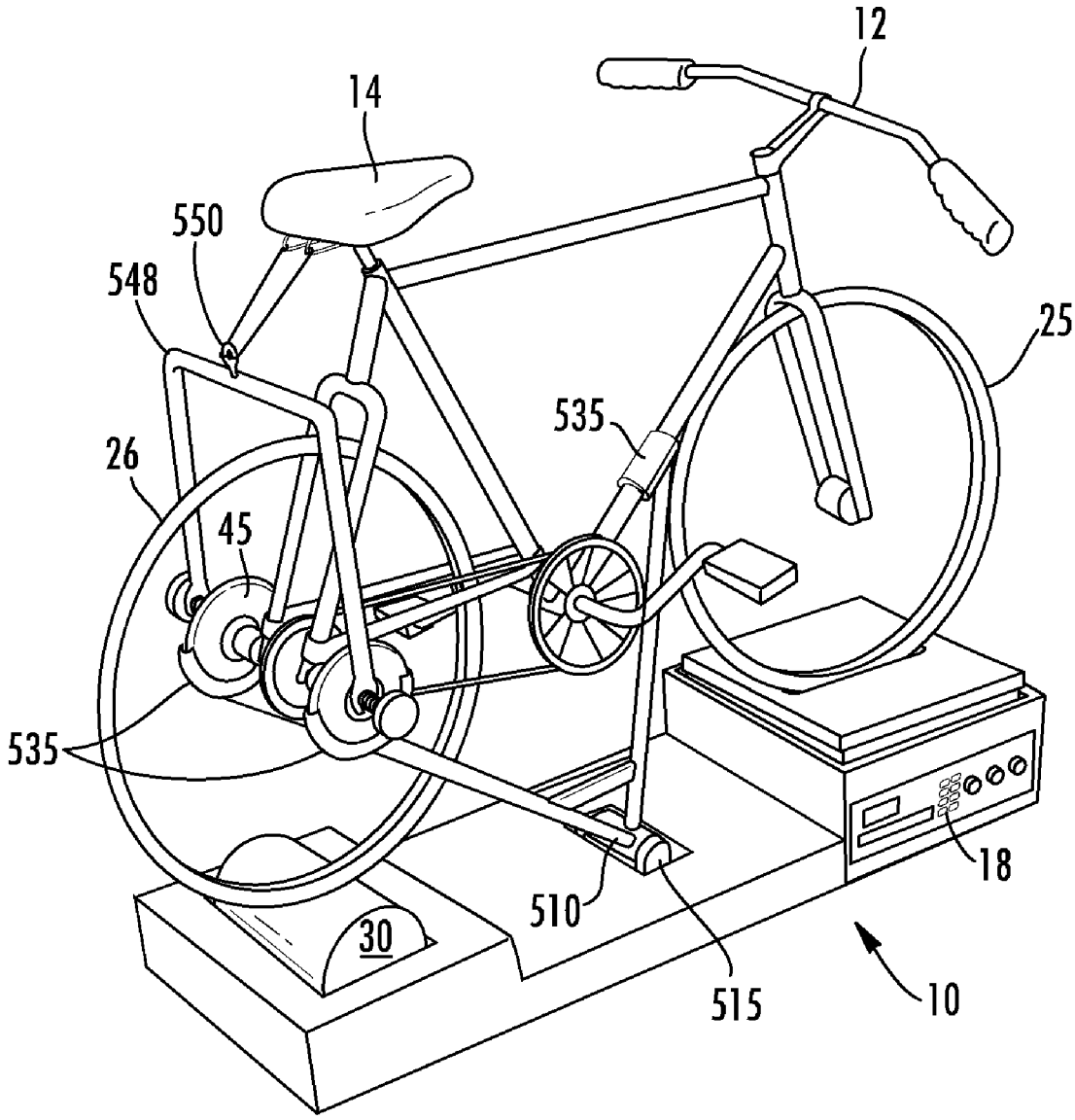
FIG. 5D is a perspective view of a trainer having a tilting mechanism for allowing arcuate movement of an attached bicycle via cupped axle connectors utilizing a U-Bar stabilizer.

FIG. 5D shows the rear of the trainer (10) in an embodiment that moves the U-Bar to a convenient position substantially behind the bicycle seat (14). Connector (550) allows the U-bar (548) to be held in place by attachment mechanisms running from the U-bar (548) to the seat (14). The support rods (510) terminate with cup-like fittings (535) that allow secure engagement with the bicycle (12) and the rollers (45) of the axle assembly.

In operation, the embodiments of FIGS. 5A-5D allow the rider to vary resistance between the resistance cylinder (30) and rear tire (26) by pivoting the tilting mechanism (support rods) in an arcuate motion.

Figure 6A:
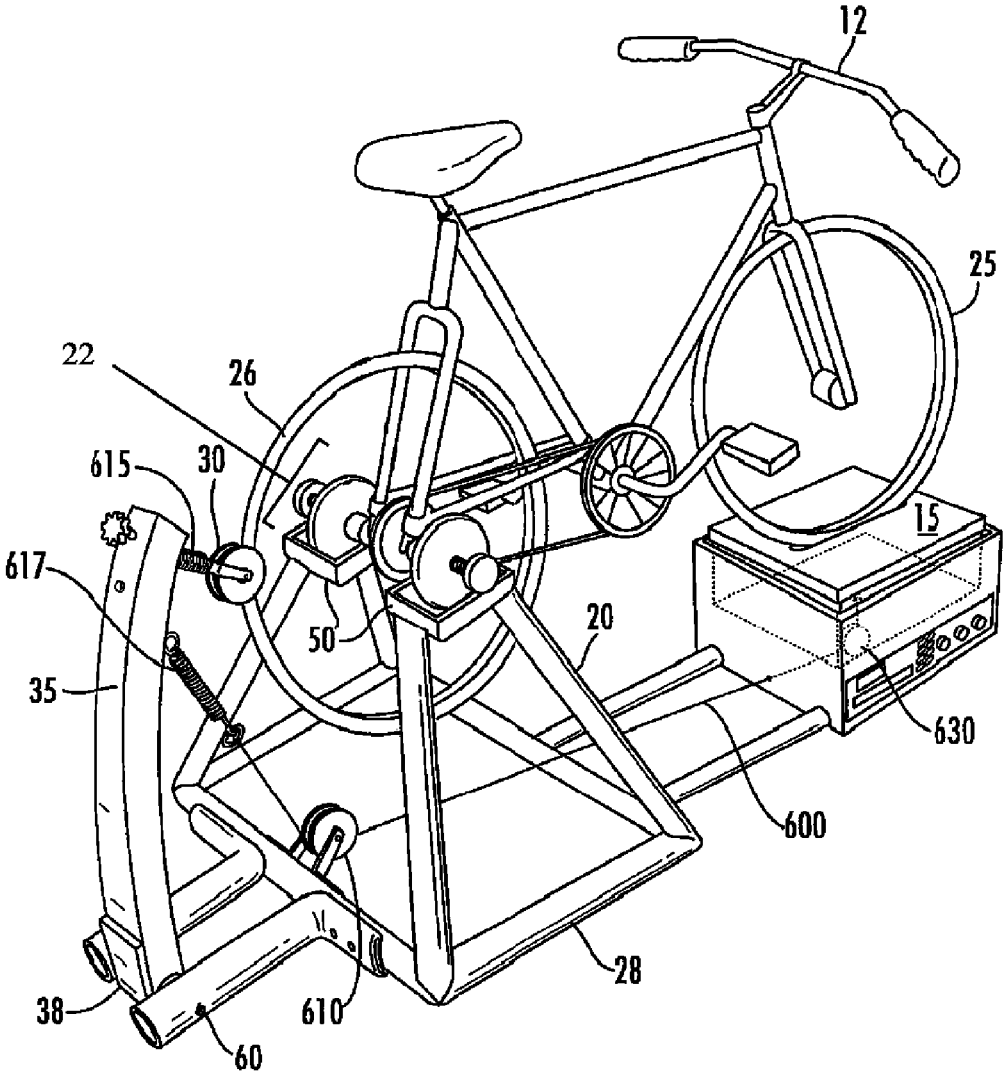
FIG. 6A is a perspective view of a trainer having a cable and pulley resistance mechanism in accordance with the invention.
Figure 6B:
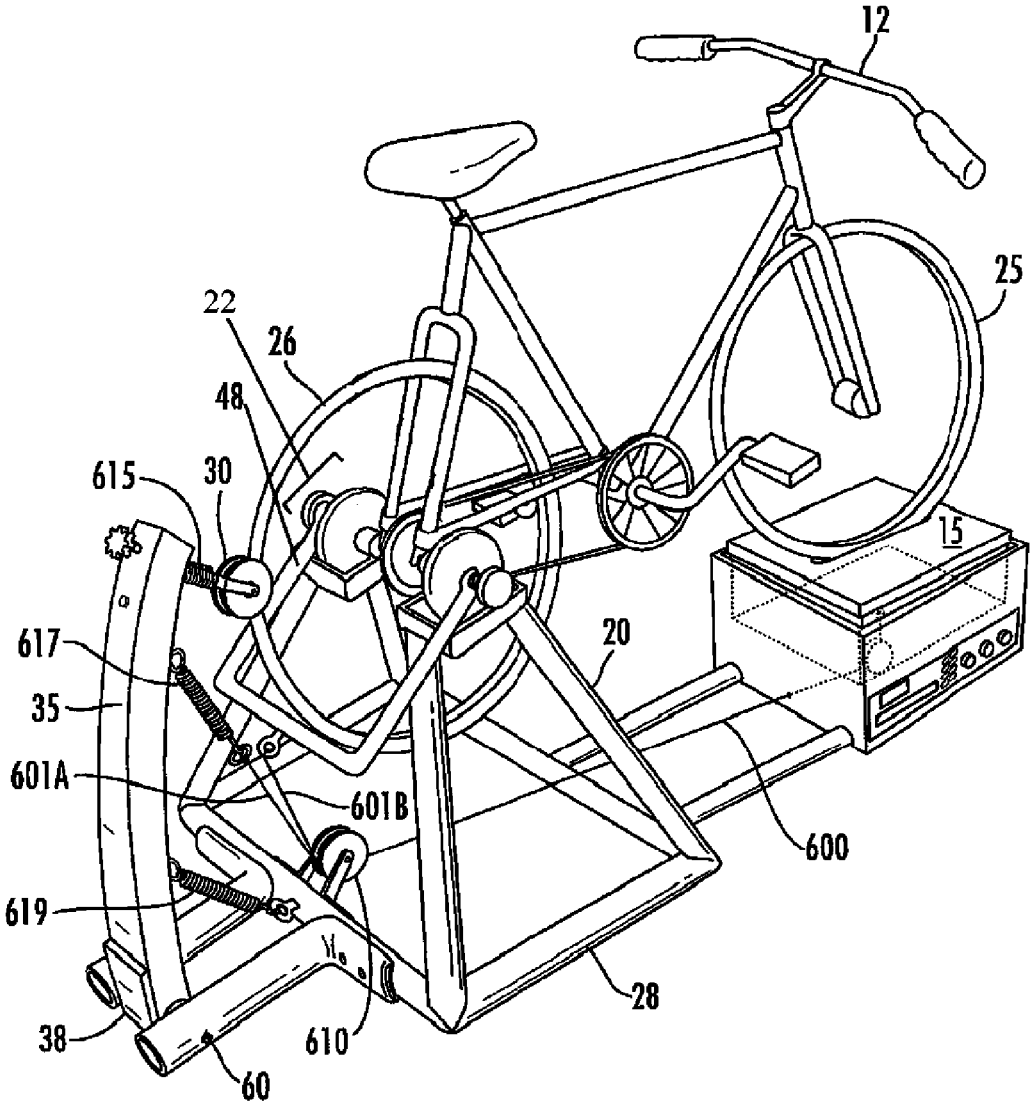
FIG. 6B is a perspective view of the rear end of the cable and pulley mechanism of FIG. 6A with additional spring work for added resistance.

FIG. 6A shows yet another embodiment of the invention. The trainer (12) of FIG. 6A includes the lifting mechanism (15) and the trainer frame (20) of FIG. 1. The trainer (10) of FIG. 6 is characterized by a cable (600) and pulley (610) mechanism for controlling the resistance to pedaling. The bicycle (12) of FIG. 6 is attached to the trainer (10) at its rear tire axle (27). Although FIG. 6 shows that the trainer allows for forward and backward translation (see translation platforms (50)), the cabling mechanisms work equally well with a standard bicycle frame attachment that does not allow lateral movement. In one preferred embodiment, therefore, the rear tire (26) only pivots about the trainer's rear tire support (22).

As shown at the front end of the trainer (10) in FIG. 6, the trainer includes a reel (630) for releasing and re-winding a cable (600) attached to a pulley mechanism (610). The pulley (610) directs the cable (600) to the constant pressure spring (617) attached to the trainer bar (35). The retraction spring (615) modulates the amount of resistance that the rear tire (26) encounters when in contact with the resistance cylinder (30). The tension in that spring (615) determines the absolute minimum amount of contact between the resistance cylinder (30) and the rear tire (26). As noted above, the trainer bar (35) pivots about the trainer frame (20) at its lower end via a pivoting bolt (60) that allows the trainer bar (35) latitude of arcuate movement about the lower pivoting bolt (60). The constant pressure spring (617) pulls the trainer bar (35) downward toward the base (28) by connecting to the underside of the trainer bar (35) and the cable (600). The constant pressure spring (617) thereby biases the resistance cylinder (30) toward an attached bicycle (12). In this embodiment, as the lifting mechanism (15) moves the front tire (25) up, the reel (630) pulls the cable (600) forward, adding resistance by positioning the trainer bar (35) closer to the rear tire (26) of the bicycle (12). The resistance cylinder (30) of this embodiment is again attached to a contact spring (615) that further disposes the trainer bar (35) toward the bicycle rear tire (26). Accordingly, as the lifting mechanism (15) moves up and down, the cable (600) becomes correspondingly more tense and less tense respectively, thereby pulling the trainer bar (35) and the associated resistance cylinder (30) in the corresponding direction closer to or farther from the rear tire (26).

The resistance cylinder (30) of FIG. 6 may be a simple rotating cylinder (30) as shown or may include the more complex resistance cylinders of the above-noted embodiments. In yet another embodiment, the cable (600) is bifurcated into extensions (601A, 601B), and the constant pressure spring (617) is connected to one of the extensions (601A). The opposite extension (601B) attaches to a U-Bar (48) that allows the cable (600) to control bicycle position in relation to the resistance cylinder (30). In other words, as the reel (630) loosens and tightens the cable (600) in accordance with the height of the lifting mechanism (15), the single pulley (610) allows the cable (600) to pull the rear tire (26) closer to the resistance cylinder (30) for a more strenuous ride or loosen the contact for an easier ride. In any event, secondary control spring (619) maintains the trainer bar (35) in a desirable position for a training exercise.

Figure 7A:
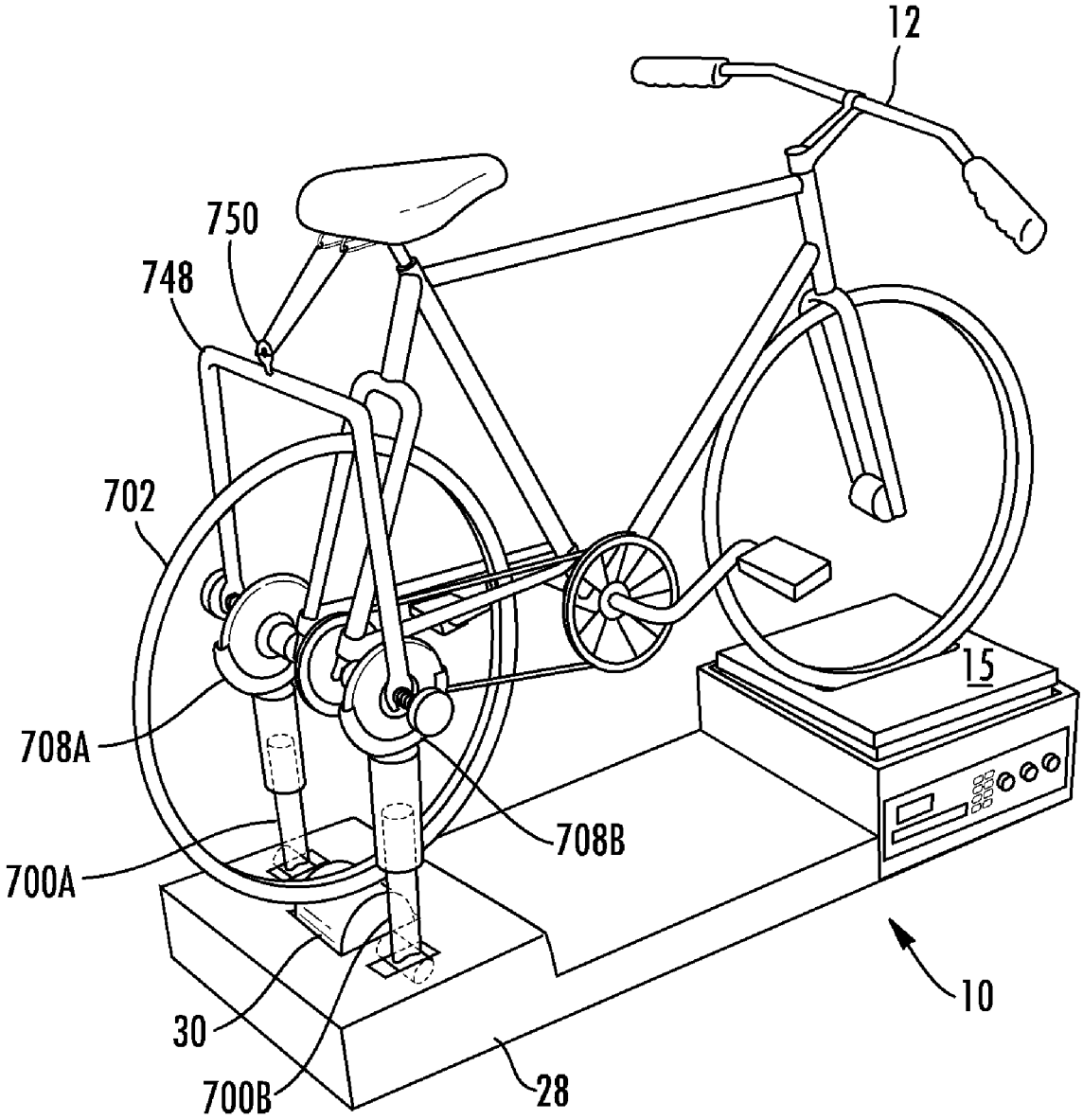
FIG. 7A is a perspective view of a hydraulic trainer in accordance with this invention.

The embodiments of FIGS. 7 and 8 present changes to the trainer (10) directed to moving either parts of the bicycle (12) or parts of the trainer up and down to vary resistance to pedaling. Again, the features that provide resistance to pedaling may include any of the features noted above in regard to other embodiments. The trainer of FIG. 7A is characterized in part by hydraulic lifts that are attached by hydraulic support posts (700A, 700B) to the body of the bicycle (12). In this embodiment, a programmable hydraulic system lifts both the front end of the bicycle via a lifting mechanism (15) and simultaneously adjusts the pressure at which the rear tire (702) engages the resistance cylinder (30). Preferably, the base (28) of the trainer (10) houses all hydraulics. Although hydraulics are preferred for the lifting mechanism, the trainer of FIG. 7 may include any other means of lifting parts of the bicycle known in the art today.

Figure 7B:
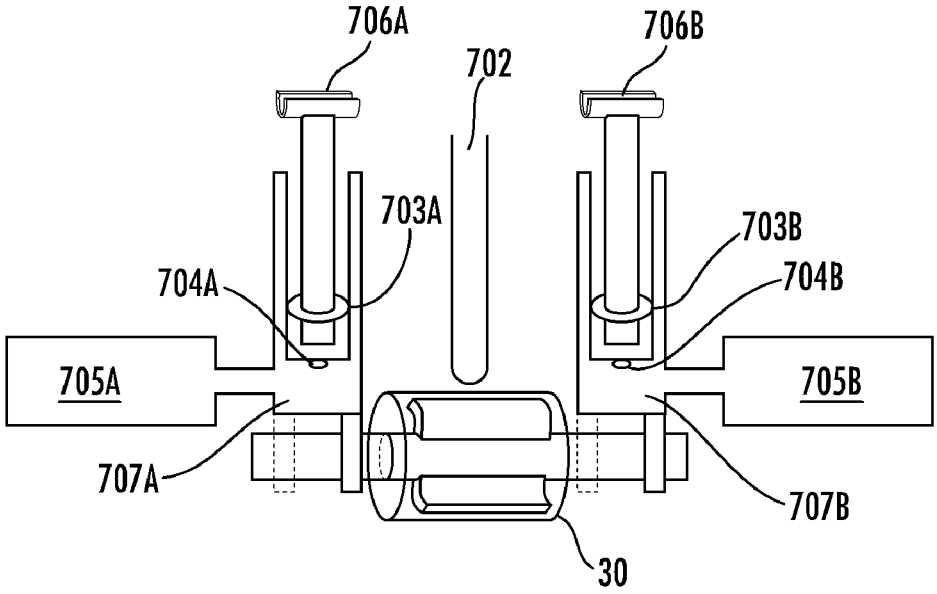
FIG. 7B is a schematic view of a hydraulic actuator for adjusting the rear tire resistance in the trainer of FIG. 7A.
Figure 7C:
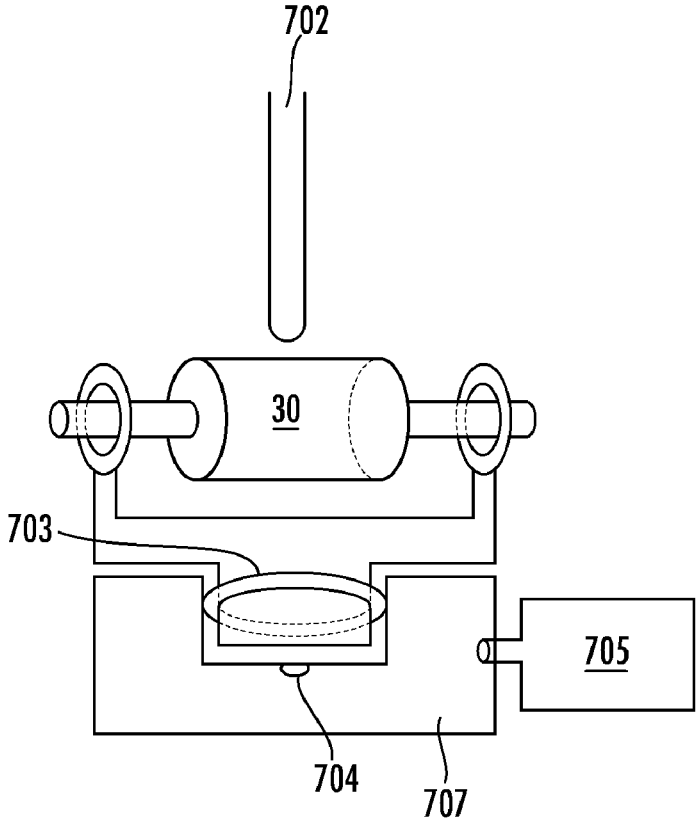
FIG. 7C is a close up view of a hydraulic actuator for adjusting the position of a resistance cylinder in a trainer according to this invention.

FIG. 7B shows a more general schematic view of the hydraulic set-up within the trainer (10). FIG. 7C shows more details about the hydraulic trainer of this invention. Pumps (705A, 705B) control the flow of hydraulic fluid into respective chambers (707A, 707B) formed between the body of the trainer and O-rings (703A, 703B) positioned about the hydraulic support posts (700A, 700B). Ports (704A, 704B) allow hydraulic fluid to push the hydraulic support posts up and retract the hydraulic support posts back down. With the hydraulic support posts connected at support cups (708A, 708B) to the body of the bicycle (12), the hydraulics control the extent to which the rear tire (702) of the bicycle engages the resistance cylinder (30).

FIG. 7C shows a closer view of another embodiment in which a single pump (705) controls hydraulic fluid flow into and out of a chamber (707) via port (704). In this embodiment, however, the hydraulic fluid pushes the resistance cylinder up and down to engage the rear tire (26) on the bicycle (12). All embodiments of FIGS. 7A-7C adjust the resistance to pedaling by contacting the rear tire (702) and the resistance cylinder (30) to varying degrees. Whether the rear tire (702) moves up and down or whether the resistance cylinder moves up and down, the pressure at the interface of the tire and the resistance cylinder determines the resistance to pedaling.

Figure 8A:
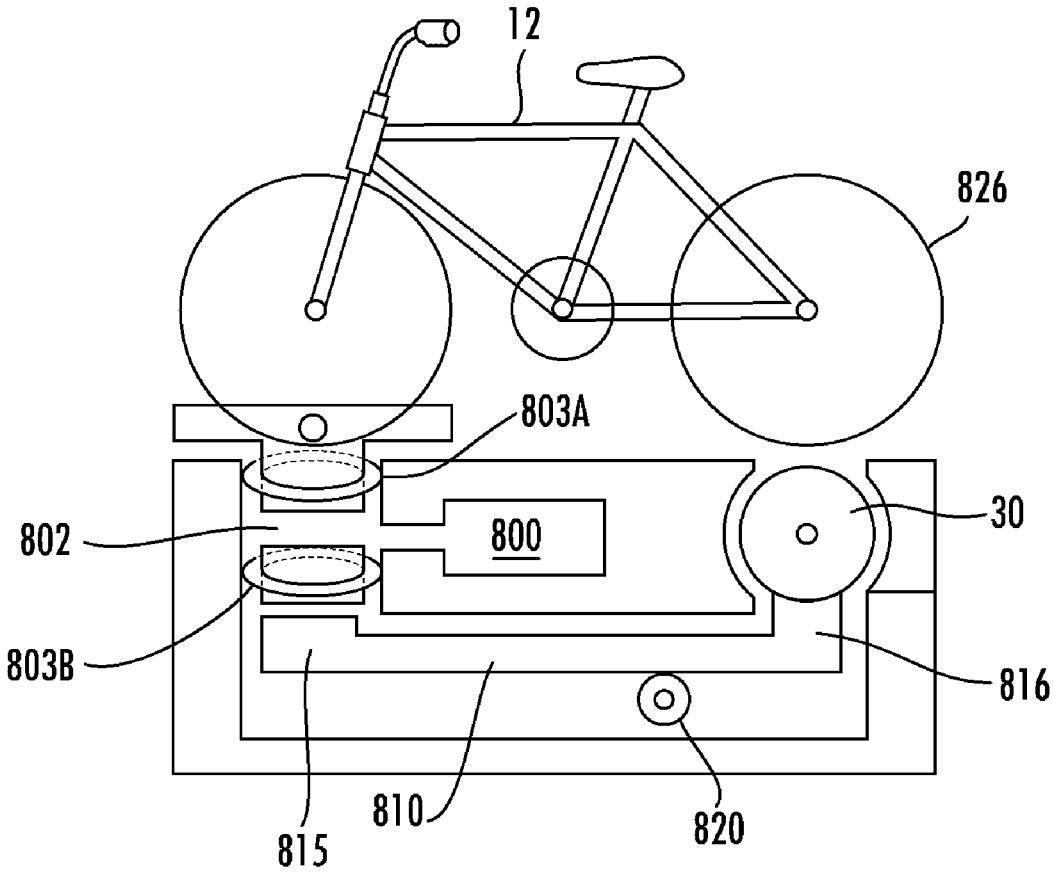
FIGS. 8A and 8B are side and rear views, respectively, of a trainer according to this invention using a lever to adjust front tire height and rear tire resistance in accordance with this invention.
Figure 8B:
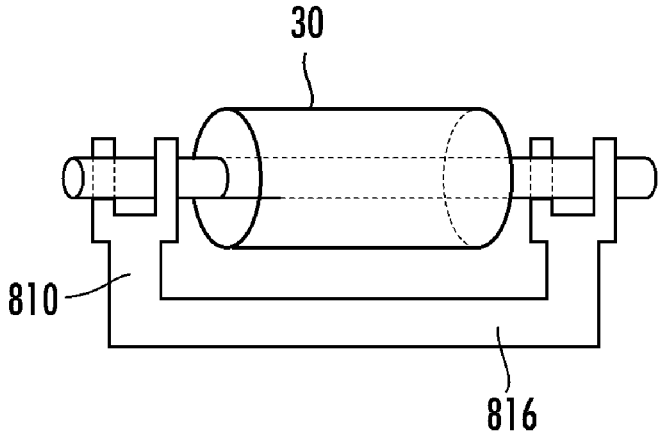
Figure 8C:
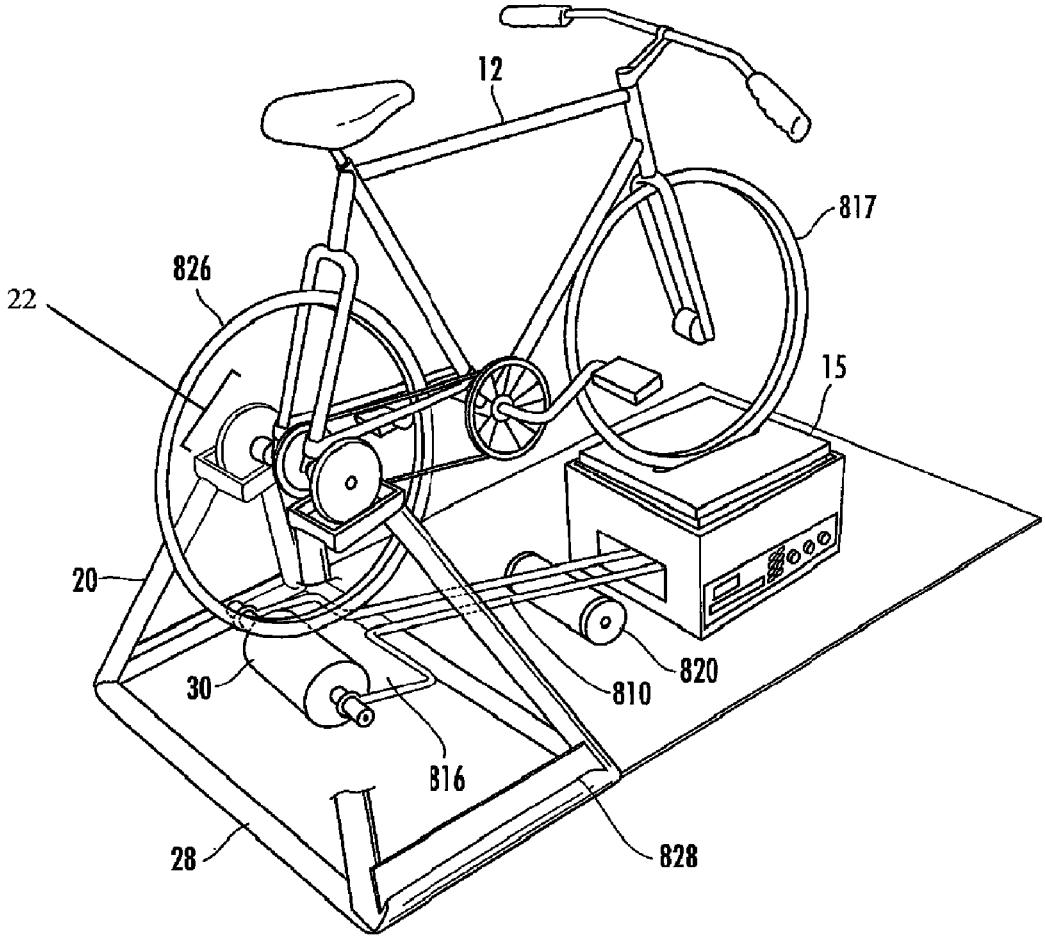
FIG. 8C is a perspective view of a trainer according to this invention using a lever to adjust front tire height and rear tire resistance.

FIGS. 8A-8C shows a trainer that uses a common energy source (800) for controlling the position of the front tire (25) of the bicycle (12) and the rear resistance cylinder (30). Without limiting the invention, in a preferred embodiment, the energy source (800) is a hydraulic pump that pushes hydraulic fluid into the control chamber (802). The fluid in the control chamber (802) engages the lifting mechanism (15) that lifts the front end of the bicycle (12). The fluid simultaneously engages a lever (810) installed within the trainer base (28). As the fluid raises the lifting mechanism (15), it lowers the front end (815) of the lever (810). Simultaneously, the rear end (816) of the lever (810) raises up, pushing the resistance cylinder (30) to a higher level of pressure against the rear tire (826) of the bicycle (12). The resistance cylinder (30) moves upward toward the rear tire (26) and adding more resistance to pedaling. In other words, the lifting mechanism (15) and the lever (810) work in unison to control the resistance to pedaling via a pump controlling the volume of hydraulic fluid within the chamber (802). As shown in FIG. 8, the lever pivots about a pivot point (820) in the trainer base (28).

FIG. 8B is a rear view of the lever (810) engaging the resistance cylinder (30). The lever (810) pushes the resistance cylinder (30) into and out of contact with the rear tire in accordance with the rider's preferences. The trainer of FIG. 8 is not limited to standard hydraulics. It is entirely within the scope of the trainer for other lifting mechanisms to be used to accomplish the same goal.

FIG. 8C is a perspective view of this embodiment. In this preferred scenario, the trainer incorporates the rear tire support (22) discussed above in regard to FIG. 1. The base (828) of the trainer includes those interior mechanics discussed in regard to FIGS. 8A and 8B as well as a rear tire support (22) attached to the overall frame.

Figure 8D:
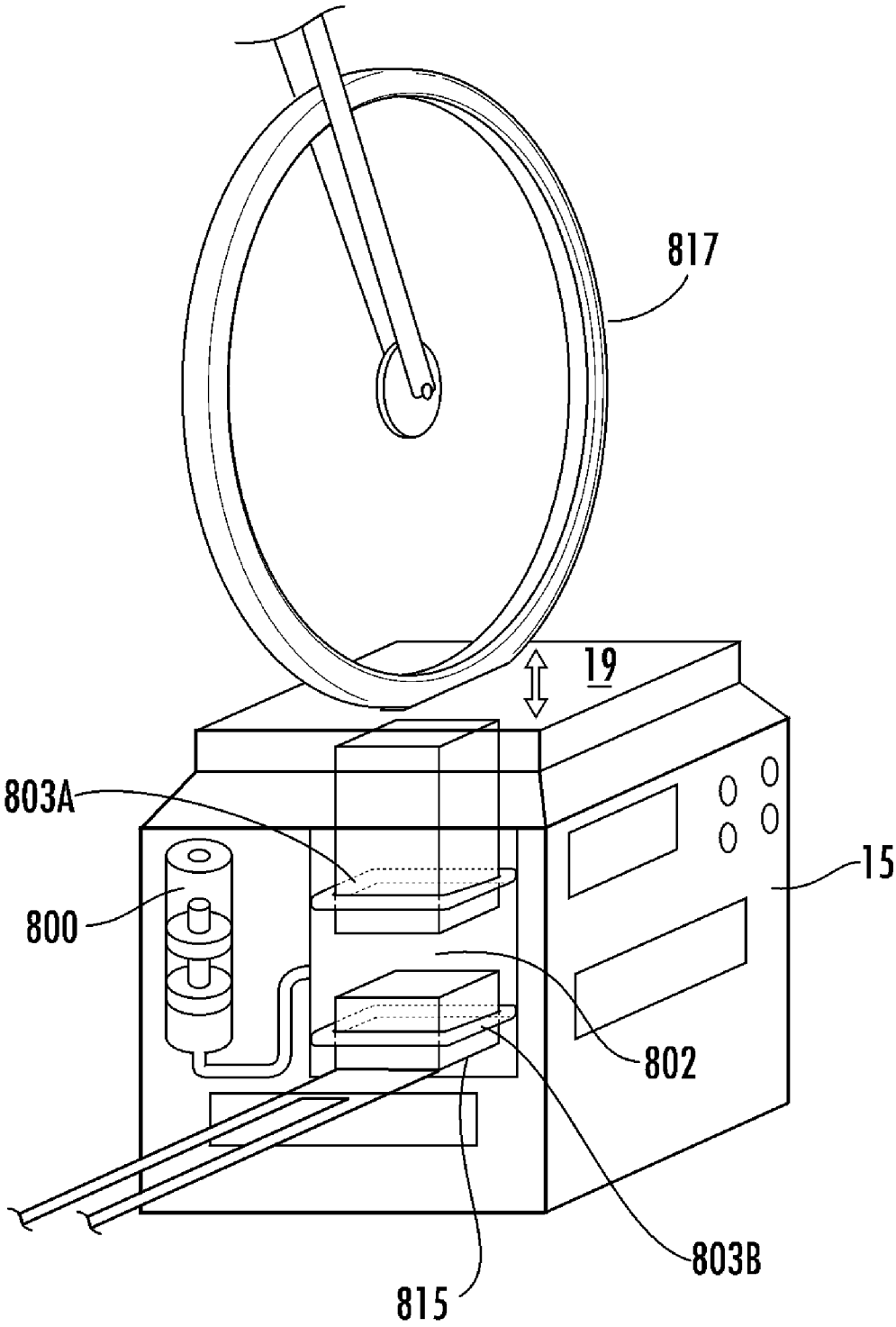
FIG. 8D is a schematic view of one embodiment of a front tire lift for use in the trainer of FIGS. 8A-8C according to this invention.

As noted above, each embodiment of this invention is suitable for use with an electronic control system that coordinates the training experience by adjusting the rear tire resistance and the front tire height. The front tire height, of course, is controlled by lifting mechanism (15). FIG. 8D shows one possible embodiment of the lifting mechanism of this invention. Pump (800) is the common energy source for pushing hydraulics in the appropriate direction to manage resistance to pedaling. Seals (803A, 803B) create the cavity (802) in accordance with the above description. Mechanical parts within the lifting mechanism move the platform (19) up and down for corresponding changes in the height of the front tire (817). In other words, the hydraulic fluid in the cavity (802) pushes the mechanical lift upward and the front end of the lever (815) downward for operation as described above.

It is entirely within the scope of the invention for all embodiments of the trainer to accommodate electronic control circuitry for controlling pumps, hydraulics, mechanical moving parts, and the front end lift. The electronic controls may be used in conjunction with known electronic players such as CD-Roms and other media that allow a user to simulate a real world geographical bicycle course via the trainer described herein. In this regard, the controller (200) shown in FIG. 4 as controlling a pump (225) may also control the tilting mechanism (500) of FIG. 5, the cabling embodiment of FIG. 6, and the hydraulic embodiments of FIG. 7 and FIG. 8. Although the control system is not shown in all of the drawings, every embodiment is intended to be used with a computerized system of controlling the front lift (15) and the amount of resistance to pedaling provided at the resistance cylinder (30).

Those having skill in the art will recognize that the invention may be embodied in many different types of trainers that use multiple combinations of the features noted above. Accordingly, the invention is not limited to the particular structures or software illustrated herein. In the drawings and specification there has been set forth a preferred embodiment of the invention, and although specific terms have been employed, they are used in a generic and descriptive sense only and not for purposes of limitation, the scope of the invention being defined in the claims.

The invention claimed is:

1. A bicycle trainer for removably attaching a bicycle and providing variable resistance to pedaling, comprising:

a lifting mechanism adapted to engage a front tire of the bicycle, wherein the lifting mechanism comprises a height controller;

a frame adapted to engage a rear tire of the bicycle, said frame comprising a rear tire support lifting the rear tire and allowing the bicycle to translate backward and forward as the lifting mechanism raises and lowers the front tire;

a resistance cylinder attached to said frame and providing a source of resistance to said rear tire; and wherein the translation of the bicycle creates the variable resistance as a function of the rear tire pressure against the resistance cylinder as determined by the height of the lifting mechanism.

2. A trainer according to claim 1, wherein said lifting mechanism comprises a front platform for stabilizing the front tire of the bicycle.

3. A trainer according to claim 1, wherein said height controller comprises a computerized module providing automated information regarding changing the height of the lifting mechanism as a function of simulated distance traveled by the back tire.

4. A trainer according to claim 3, wherein said computerized module includes electronic information for simulating a particular riding course.

5. A trainer according to claim 1, wherein:

said rear tire support comprises:

a pair of caps engaging each end of an axle of the rear tire;

rollers attached to said caps on either side of the rear tire axle, a pair of translation platforms attached to said frame such that the rear tire axle extends between said platforms;

said rollers engaging the translation platforms and allowing the bicycle to translate back and forth as the lifting mechanism moves up and down.

6. A trainer according to claim 5, further comprising a U-shaped bracket removably attached to said frame.

7. A trainer according to claim 6, wherein the U-shaped bracket is attached to said frame by a retraction spring for biasing said rear tire toward said resistance cylinder.

8. A trainer according to claim 1, further comprising a constant pressure spring for biasing said resistance cylinder toward said rear tire.

* * * * *